US009222682B2

(12) United States Patent
Vandrak

(10) Patent No.: US 9,222,682 B2
(45) **Date of Patent: *Dec. 29, 2015**

(54) PORTABLE CATALYTIC HEATER

(71) Applicant: Brian S. Vandrak, Highland Heights, OH (US)

(72) Inventor: Brian S. Vandrak, Highland Heights, OH (US)

(73) Assignee: Enerco Group, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/190,155

(22) Filed: Feb. 26, 2014

(65) Prior Publication Data

US 2014/0175184 A1 Jun. 26, 2014

Related U.S. Application Data

(63) Continuation of application No. 12/544,466, filed on Aug. 20, 2009, now Pat. No. 8,684,276.

(51) Int. Cl.
*F23C 13/00* (2006.01)
*F23D 14/18* (2006.01)
(Continued)

(52) U.S. Cl.
CPC ..... *F24D 19/1084* (2013.01); *F23D 14/18* (2013.01); *F23N 5/245* (2013.01); *F24H 1/0045* (2013.01); *F23D 2208/005* (2013.01); *F23N 2029/02* (2013.01)

(58) Field of Classification Search
CPC ..... F23N 5/24; F23N 5/242; F23N 5/245; F23N 5/247; F23N 5/10; F23N 2025/16; F23N 2029/22; F23C 13/02; F23C 13/00; F23C 2900/13001; F23C 2900/00001; F23D 5/126; F23D 14/725; F23D 14/18; F23D 2208/10
USPC ..... 237/2 A, 2 R; 34/94; 126/116 A; 422/110
IPC ..... F23C 13/02, 5/16, 14/18; F23N 5/24
See application file for complete search history.

(56) References Cited

U.S. PATENT DOCUMENTS

| | | | |
|---|---|---|---|
| 1,639,780 | A | 8/1927 | Mulholland |
| 2,997,869 | A | 8/1961 | Weiss |

(Continued)

FOREIGN PATENT DOCUMENTS

| | | |
|---|---|---|
| GB | 253043 | 6/1926 |
| JP | S54-116747 | 9/1979 |

(Continued)

OTHER PUBLICATIONS

O'Meara Camping Centers (web page), Cookers & Heaters, "Alvima Carasol 3b Heater", data sheets, pp. 1-7, Jun. 26, 2002.

*Primary Examiner* — Gregory Huson
*Assistant Examiner* — Daniel E Namay
(74) *Attorney, Agent, or Firm* — Brouse McDowell; Michael G. Craig

(57) ABSTRACT

One or more techniques and/or systems are disclosed for a portable heating device comprising a combustion-powered heater, a regulator, and an air quality detector, such as an oxygen depletion sensor. The combustion-powered heater may be supplied by an associated fuel source and may comprise a combustion region comprising a catalytic surface. The regulator may be adapted for fluid communication with the associated fuel source. The air quality detector may comprise a burner and a temperature detector. The burner may be in fluid communication with the regulator and may be adapted to combust fuel form the regulator with air to produce a flame. The temperature detector may be adapted to detect the temperature of the flame and may be adapted to selectively render the combustion-powered heater non-functional.

20 Claims, 2 Drawing Sheets

(51) Int. Cl.

| | |
|---|---|
| ***F23N 5/24*** | (2006.01) |
| ***F24D 19/10*** | (2006.01) |
| ***F24H 1/00*** | (2006.01) |
| *F23D 5/16* | (2006.01) |

(56) References Cited

U.S. PATENT DOCUMENTS

| | | | | |
|---|---|---|---|---|
| 3,139,879 | A | 7/1964 | Bauer et al. | |
| 3,240,256 | A | 3/1966 | Binkley et al. | |
| 3,529,911 | A * | 9/1970 | Townsend | 431/107 |
| 3,590,806 | A | 7/1971 | Lock | |
| 3,814,573 | A | 6/1974 | Karlovetz | |
| 3,876,365 | A * | 4/1975 | Hefling et al. | 431/329 |
| D243,694 | S | 3/1977 | Faulkner | |
| 4,068,651 | A | 1/1978 | Rappaport | |
| 4,157,241 | A * | 6/1979 | Samuelson | 431/353 |
| 4,201,544 | A | 5/1980 | Briggs et al. | |
| 4,301,035 | A * | 11/1981 | Risse | 502/256 |
| 4,307,701 | A | 12/1981 | Balon et al. | |
| 4,318,687 | A * | 3/1982 | Inoue | 431/54 |
| 4,340,362 | A | 7/1982 | Chalupsky et al. | |
| 4,348,172 | A | 9/1982 | Miller | |
| 4,357,929 | A | 11/1982 | Johnson | |
| 4,447,204 | A * | 5/1984 | Isenberg | 431/76 |
| 4,640,680 | A | 2/1987 | Schilling | |
| 4,782,814 | A | 11/1988 | Cherryholmes | |
| 4,843,313 | A | 6/1989 | Walton | |
| 4,848,313 | A | 7/1989 | Velie | |
| 5,090,899 | A | 2/1992 | Kee | |
| 5,094,611 | A | 3/1992 | Suppiah et al. | |
| 5,174,751 | A | 12/1992 | Chapman et al. | |
| 5,215,456 | A | 6/1993 | Fujiwara | |
| 5,239,979 | A | 8/1993 | Maurice et al. | |
| 5,320,518 | A | 6/1994 | Stilger et al. | |
| 5,368,475 | A | 11/1994 | Suppiah et al. | |
| 5,394,862 | A | 3/1995 | Firatli et al. | |
| 5,470,018 | A | 11/1995 | Smith | |
| 5,546,925 | A | 8/1996 | Knight et al. | |
| 5,628,303 | A | 5/1997 | Ahmady et al. | |
| 5,645,043 | A | 7/1997 | Long et al. | |
| D391,345 | S | 2/1998 | Mandi et al. | |
| 5,721,385 | A * | 2/1998 | Charmer | 73/865.6 |
| 5,807,098 | A | 9/1998 | Deng | |
| 5,838,243 | A | 11/1998 | Gallo | |
| 5,848,585 | A | 12/1998 | Long et al. | |
| 5,865,618 | A | 2/1999 | Hiebert | |
| 5,941,699 | A | 8/1999 | Abele | |
| 5,948,377 | A | 9/1999 | Sung | |
| 5,981,427 | A | 11/1999 | Sung et al. | |
| 5,984,663 | A | 11/1999 | Joyce | |
| 6,099,806 | A | 8/2000 | Cortellucci et al. | |
| 6,162,046 | A | 12/2000 | Young et al. | |
| D445,889 | S | 7/2001 | Resmo et al. | |
| D447,796 | S | 9/2001 | Resmo et al. | |
| 6,340,298 | B1 | 1/2002 | Vandrak et al. | |
| 6,446,623 | B1 | 9/2002 | Resmo et al. | |
| 6,526,964 | B1 | 3/2003 | Potter et al. | |
| 6,575,154 | B1 | 6/2003 | Freeman et al. | |
| 6,585,509 | B2 | 7/2003 | Young et al. | |
| 6,592,361 | B2 | 7/2003 | Adiga et al. | |
| 6,619,281 | B2 | 9/2003 | Resmo et al. | |
| 6,634,320 | B2 * | 10/2003 | Grando et al. | 122/14.2 |
| 6,648,635 | B2 | 11/2003 | Vandrak et al. | |
| 6,742,814 | B2 | 6/2004 | Resmo et al. | |
| 6,792,937 | B2 | 9/2004 | Resmo et al. | |
| 6,843,244 | B2 | 1/2005 | McCalley et al. | |
| 6,921,738 | B2 | 7/2005 | Hwang et al. | |
| 7,434,447 | B2 * | 10/2008 | Deng | 73/23.2 |
| 7,654,820 | B2 * | 2/2010 | Deng | 431/74 |
| 7,837,930 | B2 | 11/2010 | Grodsky | |
| 7,988,984 | B2 | 8/2011 | Hockaday | |
| 8,434,469 | B2 | 5/2013 | Vandrak | |
| 8,684,276 | B2 * | 4/2014 | Vandrak | 237/2 R |
| 2002/0106597 | A1 | 8/2002 | Grando et al. | |
| 2002/0160325 | A1 * | 10/2002 | Deng | 431/76 |
| 2002/0160326 | A1 * | 10/2002 | Deng | 431/79 |
| 2004/0096790 | A1 * | 5/2004 | Querejeta et al. | 431/80 |
| 2004/0170936 | A1 | 9/2004 | Weclas et al. | |
| 2004/0209206 | A1 | 10/2004 | Hockadat et al. | |
| 2004/0226600 | A1 * | 11/2004 | Starer et al. | 136/224 |
| 2005/0066958 | A1 * | 3/2005 | Guzorek | 126/285 R |
| 2005/0196719 | A1 | 9/2005 | Mills et al. | |
| 2005/0210737 | A1 | 9/2005 | Durand et al. | |
| 2005/0233272 | A1 * | 10/2005 | Giacomelli et al. | 431/18 |
| 2005/0257786 | A1 | 11/2005 | Vandrak et al. | |
| 2006/0070255 | A1 | 4/2006 | Kokuo et al. | |
| 2007/0042301 | A1 | 2/2007 | Carroni et al. | |
| 2007/0099136 | A1 | 5/2007 | Cook | |
| 2007/0104625 | A1 | 5/2007 | Su | |
| 2007/0186872 | A1 | 8/2007 | Shellenberger et al. | |
| 2008/0020336 | A1 | 1/2008 | Kaeding et al. | |
| 2008/0092433 | A1 | 4/2008 | Durand et al. | |
| 2008/0092513 | A1 | 4/2008 | Carroni et al. | |
| 2008/0096062 | A1 | 4/2008 | Lee et al. | |
| 2008/0113306 | A1 | 5/2008 | Veasey et al. | |
| 2008/0220384 | A1 * | 9/2008 | Bridgwater et al. | 431/18 |
| 2009/0280448 | A1 | 11/2009 | Antxia et al. | |
| 2010/0024431 | A1 * | 2/2010 | Panov | 60/779 |
| 2010/0040915 | A1 | 2/2010 | Wakita et al. | |
| 2010/0126070 | A1 | 5/2010 | Lee et al. | |
| 2010/0147291 | A1 | 6/2010 | Vandrak | |
| 2010/0282325 | A1 | 11/2010 | Cimino | |
| 2011/0039217 | A1 * | 2/2011 | Happe | 431/12 |
| 2011/0042472 | A1 | 2/2011 | Vandrak | |
| 2011/0126816 | A1 | 6/2011 | Salbide et al. | |
| 2013/0008423 | A1 | 1/2013 | Noble et al. | |
| 2014/0175184 | A1 * | 6/2014 | Vandrak | 237/2 A |

FOREIGN PATENT DOCUMENTS

| | | | | |
|---|---|---|---|---|
| JP | 58092711 | A * | 6/1983 | F23D 3/18 |
| JP | 01179862 | A | 7/1989 | |
| JP | 02050031 | A | 2/1990 | |

* cited by examiner

PORTABLE CATALYTIC HEATER

CROSS-REFERENCE TO RELATED APPLICATIONS

This application is a continuation of, and claims priority to, U.S. application Ser. No. 12/544,466 entitled "Portable Catalytic Heater" filed Aug. 20, 2009.

BACKGROUND

Without limitation, combustion-powered heaters may comprise catalytic heaters and heaters with burners. Combustion-powered heaters combust reactants to yield heat and reaction products. Combustion-powered heaters consume a fuel and an oxidant, and react the fuel and oxidant to yield heat and one or more combustion products. Some combustion-powered heaters modify the composition of the atmosphere by uptake of one or more reactants from the atmosphere, or release of one or more combustion products into the atmosphere, or both.

In some combustion-powered heaters, a combustion process consumes oxygen from the atmosphere as a combustion reactant. The consumption of oxygen by a combustion-powered heater can modify the composition of the atmosphere by reducing the oxygen therein. In some amounts, reduced oxygen may be undesirable. It remains desirable to develop technology to detect and address atmospheric conditions such as undesirable amounts of oxygen.

Without limitation, some combustion-powered heaters release a combustion product into the atmosphere. A combustion product may comprise, but is not limited to, carbon dioxide, carbon monoxide, nitrogen oxides. The release of a combustion product can modify the composition of the atmosphere by increasing the amount of a combustion product therein. Without limitation, increasing the amount of a combustion product in the atmosphere can decrease the percentage of other atmospheric constituents therein. Without limitation, in some amounts, the presence of a combustion product may be undesirable. It remains desirable to develop technology to detect and address atmospheric conditions such as an undesirable amount of a combustion product in the atmosphere.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, a portable heating device comprising a combustion-powered heater, a regulator, and an oxygen depletion sensor. The combustion-powered heater may be supplied by an associated fuel source and may comprise a combustion region comprising a catalytic surface. The regulator may be adapted for fluid communication with the associated fuel source. The oxygen depletion sensor may comprise a burner and a temperature detector. The burner may be in fluid communication with the regulator and may be adapted to combust fuel form the regulator with air to produce a flame. The temperature detector may be adapted to detect the temperature of the flame and may be adapted to selectively render the combustion-powered heater non-functional.

In one implementation, a portable combustion-powered heater can be supplied by an associated fuel source. The combustion-powered heater may comprise a combustion region comprising a catalytic surface, a regulator operationally engaged with the associated fuel source, a valve, and an oxygen depletion sensor operationally engaged with the regulator. The oxygen depletion sensor may comprise a burner in operative engagement with said regulator and a detector. The burner may be adapted to combust fuel in air to produce a flame. The detector may be adapted to detect a first property of the flame.

In one implementation, a portable heating device can comprise a combustion-powered heater, a regulator, a normally-closed valve, and an oxygen depletion sensor. The combustion-powered heater may be supplied by an associated fuel source. The fuel source may comprise propane. The combustion-powered heater may comprise a combustion region. The combustion region may comprise a catalyst and a substrate. The catalyst may comprise ruthenium, rhodium, palladium, osmium, iridium, platinum, or mixtures thereof. The substrate may comprise a glass fiber, a porous metal, a ceramic, or a mixture thereof. The combustion-powered heater may be adapted to consume oxygen from the atmosphere as a combustion reactant or adapted to release a combustion product into the atmosphere, or both. The regulator may be operationally engaged with the associated fuel source. The regulator may be adapted to accept a flow of fuel from the associated fuel source and output a flow of fuel. The outputted flow of fuel may be limited to a pressure of approximately eleven inches of water column. The normally-closed valve may be in fluid communication with the combustion region and in fluid communication with the associated fuel source. The normally-closed valve may be adapted to shut-off said combustion-powered heater when closed. The oxygen depletion sensor may comprise a burner and a detector. The burner may be in operative engagement with said regulator. The burner may be adapted to combust fuel in air to produce a flame. The detector may be adapted to detect a first property of the flame. The detector may be adapted to hold open said normally-closed valve unless the detected first property of the flame do not meet predetermined criteria. The flame may be adapted to have the first property not meet the predetermined criteria when the air comprises a carbon dioxide amount in the air of more than 5000 PPM, or the air comprises a carbon monoxide amount in the air of more than 100 PPM, or the air comprises at least 82% by volume non-oxygen components, or any combination thereof.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
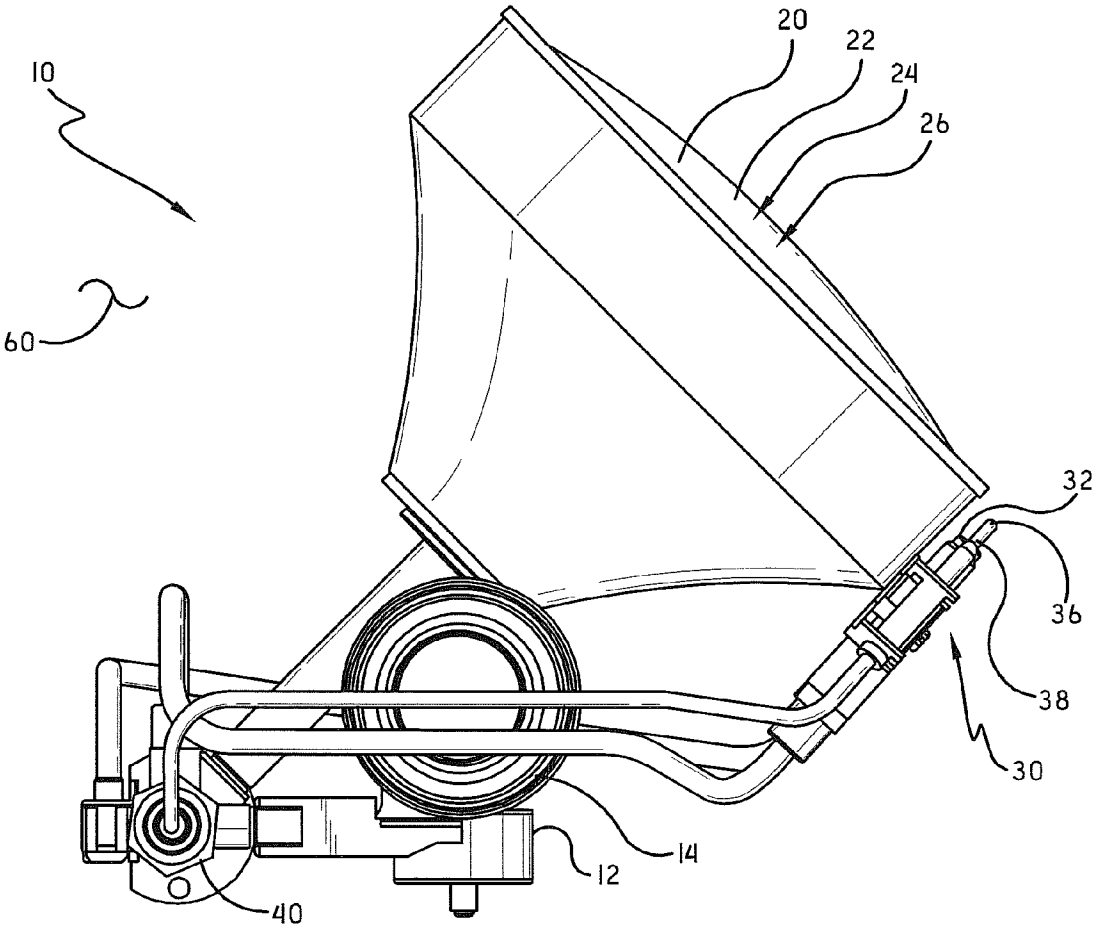
FIG. 1 is a view of one embodiment of a portable catalytic heater assembly.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

Reference will be made to the drawings, FIGS. 1-2, wherein the showings are only for purposes of illustrating certain embodiments of a portable catalytic heater, and not for purposes of limiting the same. Specific characteristics relating to the embodiments disclosed herein are not to be considered as limiting, unless the claims expressly state otherwise.

Portable heaters 10 may be combustion-powered. A combustion-powered portable heater 10 may combust a fuel and an oxidant in a combustion region 20. A combustion region 20 may comprise, without limitation, a catalytic surface 22 or a burner (not shown).

A catalytic surface 22 is a combustion region 20 adapted so that a fuel and an oxidant may react thereupon in catalyzed reaction to yield heat and a combustion product. Without limitation, some portable heaters 10 release combustion products to the atmosphere 60.

The material of the catalytic surface 22 may act as a catalyst 24 in a combustion reaction in the combustion region 20. Without limitation, a catalyst 24 in a combustion reaction may change the combustion reaction by speeding up the reaction, slowing down the reaction, lowering the ignition energy needed to initiate the combustion reaction, promoting more complete combustion, promoting cleaner combustion, reducing or eliminating certain combustion products, or increasing operating efficiency.

Without limitation, some fuels that a portable heater may react comprise, methane, ethane, propane, butane, pentane, LP gas, other gas mixtures, and kerosene. Without limitation, some oxidants that a portable heater may react comprise oxygen, gas mixtures comprising oxygen, nitrous oxide, or mixtures thereof. Without limitation, air is a gas mixture comprising oxygen that may be used to provide an oxidant for use as a combustion reactant.

Use of air, use oxygen from the air, or release of combustion products to the atmosphere 60 can affect air quality. Without limitation, some portable heaters consume oxygen from the atmosphere 60 as a combustion reactant.

Without limitation, some catalytic surfaces 22 comprise a catalyst 24 supported by a substrate 26. In certain embodiments a catalyst 24 may comprise ruthenium, rhodium, palladium, osmium, iridium, platinum, and mixtures thereof. A substrate 26 may comprise a glass fiber, a porous metal, a ceramic, or a mixture thereof.

Without limitation, a portable heater 10 may comprise an air quality detector 30 for gauging air quality directly or indirectly. In certain embodiments, an air quality detector 30 for gauging air quality may comprise an oxygen depletion sensor (e.g., 30). In certain embodiments an air quality detector 30 for gauging air quality may detect temperature.

In certain embodiments, and without limitation, an air quality detector 30, such as an oxygen depletion sensor, can comprise a burner 32 adapted to produce a flame and a temperature detector 36. In certain embodiment and without limitations, the temperature detector 36 may comprise a thermocouple, a thermoelectric material, a pyrometer, a bimetallic strip, or a thermostat. An air quality detector 30 (e.g., oxygen depletion sensor) may be adapted to detect certain levels of a gas. In some embodiments, the detector (e.g., oxygen depletion sensor) 30 may be adapted to detect undesirable levels of a gas.

In certain embodiments, of an air quality detector 30, the temperature detector 36 is adapted to detect the characteristics of temperature of a flame (not shown) produced by the burner 32. The temperature detector 36 is adapted to hold open a normally-closed valve unless the temperature of the flame does not meet a predetermined criteria. In certain embodiments, the temperature detector 36 produces a current sufficient to hold open a normally-closed valve 40 as a result of the detection of a flame temperature meeting the predetermined criteria. In some embodiments a produced current sufficient to hold open a normally-closed valve 40 may hold open the normally-closed valve 40 electromagnetically.

In certain embodiments, a flame produced by the burner 32 is adapted to have a temperature that does not meet the predetermined criteria if the air quality is bad. The quality that makes air bad is subject to engineering judgment. In certain embodiments, and without limitation, the air is bad if the air comprises a carbon dioxide amount in the air of more than 5000 PPM, or the air comprises a carbon monoxide amount in the air of more than 100 PPM, or the air comprises at least 82% by volume non-oxygen components, or any combination thereof.

Non-oxygen components refer to those components in the air, including, but not limited to, nitrogen, argon, and carbon dioxide, that are not oxygen. If oxygen is removed from the atmosphere 60, the percentage by volume of non-oxygen components may increase. If non-oxygen components, such as, without limitation, carbon monoxide, carbon dioxide, or nitrogen oxides, are introduced to the atmosphere 60, the percentage by volume of non-oxygen components may increase.

Without limitation, an air quality detector 30, comprising an oxygen depletion sensor may detect undesirable levels of oxygen, carbon monoxide, or carbon dioxide. An atmosphere 60 devoid of undesirable levels of a gas may be described as good air or as having good air quality. An atmosphere 60 comprising undesirable levels of a gas may be described as bad air or as having bad air quality.

In certain embodiments, and without limitation, the oxygen depletion sensor 30 may accept air from the atmosphere 60 for use as a reactant in the combustion of fuel in the burner 32. The composition of the atmosphere 60 can substantially affect performance of the flame produced by the burner 32 during operation. During operations in good air, the flame produced by the burner 32 of an oxygen depletion sensor 30 may be of a first predictable temperature. During operation in bad air, the flame produced by the burner 32 of an oxygen depletion sensor 30 may be of a second predictable temperature. For example, and without limitation, in some embodiments, a flame produced in bad air may be lower in temperature, cooler than, a flame produced in good air.

Because of predictable flame temperature differences between a flame produced from combustion in good air and a flame produced from combustion in bad air, a temperature detector 36 may be used to detect temperature changes related to changes of air quality and, thereby, used as a predictor of atmospheric conditions in terms of good air versus bad air. That is, a temperature detector 36 may be used to discriminate between operations within good air and operations within bad air by measuring a flame temperature affected by air quality.

In certain embodiments, and without limitation, the air quality detector (e.g., oxygen depletion sensor) 30 can comprise a burner 32 and a thermocouple 38. In certain embodiments, the temperature of the flame produced by the burner 32 in bad air is cooler than a flame produced in good air. In certain embodiments, for example, a temperature detector, such as a thermocouple 38, may be so arranged as to detect the temperature difference in the flame and to produce an output signal representative of the air quality. In certain embodiments, the thermocouple 38 may be arranged to be proximate to the flame or immersed in the flame or in any arrangement consistent with good engineering practice that will discriminate the flame temperature differences of interest. In certain embodiments, a flame produced by combustion in good air quality will produce a output signal from the thermocouple 38 consistent with good air quality, and will produce sufficient current to hold open a normally-closed valve. In certain embodiments, a flame produced by combustion in bad air quality will not produce an output signal from the thermocouple 38 consistent with good air quality, and will not produce sufficient current to hold open a normally-closed valve. In certain embodiments, a flame produced by combustion in bad air quality will not produce any substantial output signal from the thermocouple 38.

In certain embodiments, failure of the air quality detector 30 to produce an output signal consistent with good air may trigger actions to cease heater 10 operations. In certain embodiments, actions to cease heater 10 operations include shut off or shut down of the heater 10. In certain embodiments, actions to cease heater 10 operations include shut off, closing, or shut down of the heater 10 comprise closing of a valve 40 to interrupt fuel flow necessary to continuing operation of the heater 10. In certain embodiments, and without limitation, the temperature detector 36 can be operationally engaged with and facilitate in holding open a normally-closed valve 40 unless the air quality detector 30 fails to detect a temperature consistent with operation of the burner 32 in good air. In some embodiments, closing of said valve 40 terminates a flow of fuel necessary to the continued operation of heater 10 and, thereby, stops heater 10 operation.

Figure 2:
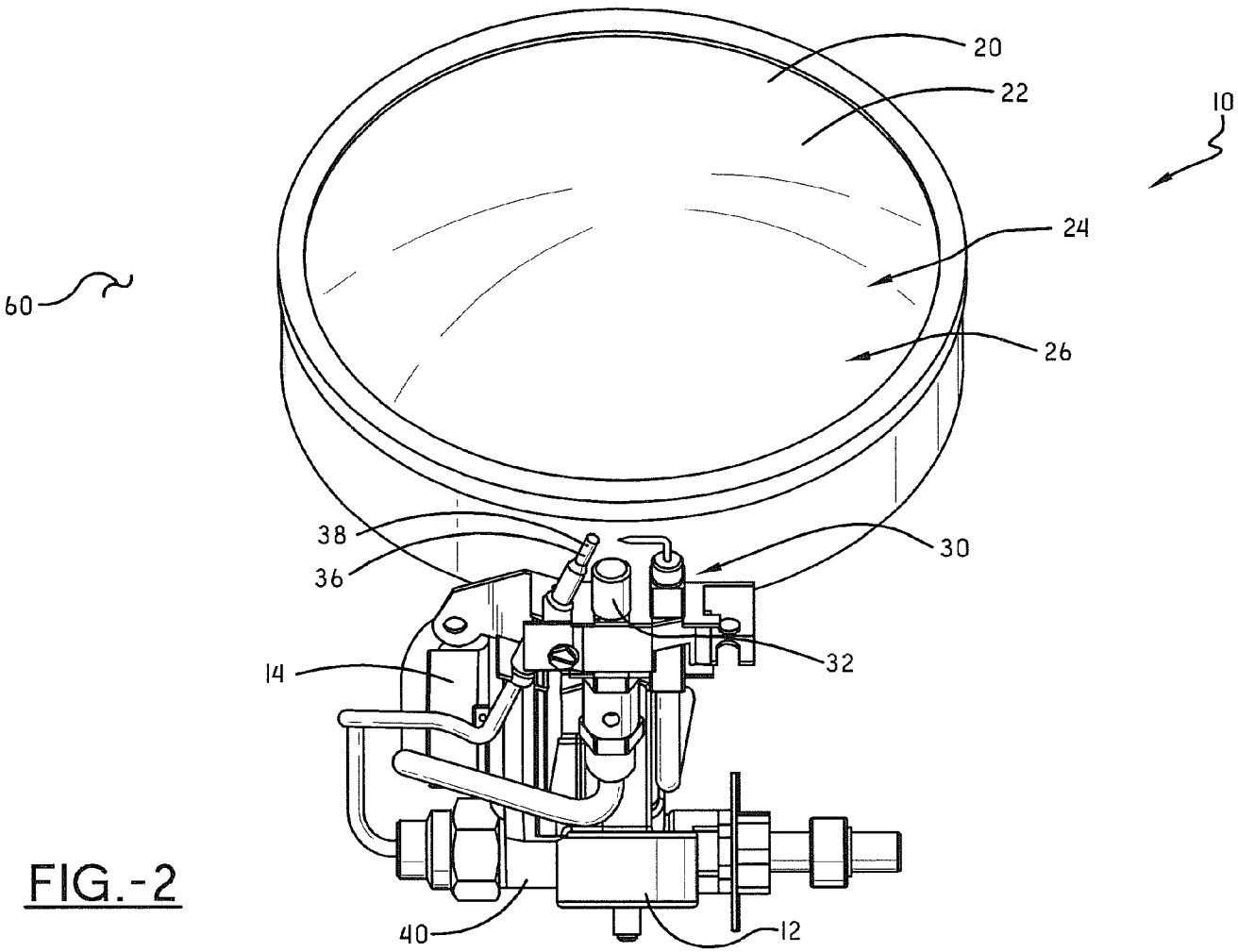
FIG. 2 is another view of one embodiment of a portable catalytic heater assembly.

In the non-limiting embodiment shown in FIGS. 1 and 2 a portable catalytic heater 10 is adapted to be supplied by an associated fuel source (not shown). Heater 10 may comprise a fuel source connection 12. Without limitation, a fuel source connection 12 may comprise a female-threaded region (not shown) adapted for connection to an associated male-threaded fuel source (not shown). Without limitation, a fuel source connection 12 may be adapted for connection to an associated propane fuel tank or bottle.

A portable catalytic heater 10 may comprise a combustion region 20 comprising a catalytic surface 22. When the portable catalytic heater 10 is in operation, the combustion region 20 may receive fuel from an associated fuel source (not shown) through a valve 40. In operation, the combustion region 20 may receive air (not shown) from the atmosphere 60 and may react the air and the fuel upon catalytic surface 26 to yield heat and a combustion product. A combustion product may be released to the atmosphere 60.

Heater 10 may, optionally, comprise a regulator 14. When the portable catalytic heater 10 is in operation, an optional regulator 14 may receive fuel from an associated fuel source 40. The regulator 14 may throughput fuel at a regulated pressure. In some embodiments, without limitation, a heater 10 may comprise a regulator 14 to regulate the pressure of fuel directed to an oxygen depletion sensor 30, a regulator 14 to regulate the pressure of fuel directed to a combustion region 20, or both. In certain embodiments, the fuel directed to an oxygen depletion sensor 30 or the fuel directed to a combustion region 20 are not regulated. Without limitation, in certain embodiments, the regulated pressure may be approximately eleven inches of water column.

In operation, burner 32 may burn the fuel with air from the atmosphere 60, may produce a flame (not shown), and may produce combustion products (not shown). A combustion product may be released to the atmosphere 60. The flame produced by burner 32 may interact with thermocouple 38 in a manner that depends upon the quality of the air. If the air is good, then flame may heat thermocouple 38 sufficiently to produce an output signal consistent with good air quality. If the air is bad, then the flame may not heat thermocouple 38 sufficiently to produce an output signal consistent with good air quality. If the thermocouple 38 is not heated sufficiently to produce an output signal consistent with good air quality, then valve 40 will close stopping fuel supply to combustion region 20 and thereby shutting down the portable catalytic heater 10.

While the portable catalytic heater has been described above in connection with the certain embodiments, it is to be understood that other embodiments may be used or modifications and additions may be made to the described embodiments for performing the same function of the portable catalytic heater without deviating therefrom. Further, the portable catalytic heater may include embodiments disclosed but not described in exacting detail. Further, all embodiments disclosed are not necessarily in the alternative, as various embodiments may be combined to provide the desired characteristics. Variations can be made by one having ordinary skill in the art without departing from the spirit and scope of the portable catalytic heater. Therefore, the portable catalytic heater should not be limited to any single embodiment, but rather construed in breadth and scope in accordance with the recitation of the attached claims.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A portable heating device comprising:

a catalytic surface configured to generate heat from a catalyzed reaction when exposed to a heating fuel and oxygen; and a fuel supply valve configured to mitigate a supply of the heating fuel to the catalytic surface when the valve is disposed in a closed position, the valve disposed in a closed position in absence of a signal indicative of a desirable atmosphere from an air quality detector, the air quality detector configured to transmit the signal indicative of the desirable atmosphere merely if a desired atmosphere is detected by the air quality detector, and the air quality detector comprising a temperature sensor configured to detect a temperature of a detector flame.

2. The device of claim 1, the catalytic surface comprising a catalyst configured to promote the generation of heat from the catalytic surface in the presence of a desired mixture of oxygen and the heating fuel.

3. The device of claim 1, the heating fuel comprising one or more of: methane; ethane; propane; butane; pentane; LP gas; kerosene; and other gas mixtures.

4. The device of claim 1, the temperature of the detector flame indicative of at least one of the desirable atmosphere and a non-desirable atmosphere.

5. The device of claim 4, the air quality detector configured to not transmit the signal indicative of the desirable atmosphere if the temperature sensor detects that the temperature of the detector flame is indicative of the non-desirable atmosphere.

6. The device of claim 1, the temperature sensor comprising one or more of: a thermocouple; a thermoelectric sensor; a pyrometer; a bimetallic sensor; and a thermostat.

7. The device of claim 1, the air quality detector comprising a detector burner configured to be a combustion site for the air quality detector flame.

8. The device of claim 1, the detector flame resulting from combustion of the heating fuel in the presence of the atmosphere in which the heating device is disposed, the detector flame combustion is not dependent on the catalyzed reaction.

9. The device of claim 1, the air quality detector configured to transmit the signal indicative of the desirable atmosphere to the valve merely if the temperature sensor detects that the temperature of the detector flame is indicative of the desirable atmosphere.

10. The device of claim 1, the oxygen provided by one or more of: atmospheric oxygen; a gas mixture comprising oxygen; and nitrous oxide.

11. The device of claim 1, the air quality detector comprising an oxygen depletion sensor (ODS).

12. The device of claim 1, the air quality detector configured to detect the desirable atmosphere based at least upon the temperature of a detector flame, the temperature of the detector flame indicative of the desirable atmosphere and a non-desirable atmosphere.

13. The device of claim 12, the temperature of the detector flame is indicative of the desirable atmosphere when the atmosphere comprises one or more of:

less than or equal to 100 PPM of carbon monoxide;

greater than or equal to 18% oxygen by volume; and less than 82% by volume non-oxygen components.

14. The device of claim 12, the air quality detector calibrated to detect the non-desirable atmosphere when the temperature of the detector flame is indicative of greater than 5000 PPM of carbon dioxide in the atmosphere, and one or more of:

greater than 100 PPM of carbon monoxide in the atmosphere;

less than 18% oxygen by volume in the atmosphere; and greater than or equal to 82% by volume non-oxygen components in the atmosphere.

15. A portable heater, comprising:

a catalytic heat generation component fluidly coupled to a fuel source;

an air quality detector configured to selectively mitigate a flow of fuel between the fuel source and the catalytic heating component when a non-desired atmosphere is detected, the air quality detector comprising:

a burner, in fluid communication with the fuel source, and configured generate a detector flame, and a temperature sensor, operably engaged with the detector flame, and configured to detect the temperature of the detector flame.

16. The heater of claim 15, comprising a valve operably engaged between the catalytic heat generation component and the fuel source, the valve configured to be disposed in a closed position in absence of a signal indicative of a desired atmosphere from the air quality detector.

17. The heater of claim 16, the valve configured to be disposed in an open position merely when the signal indicative of a desired atmosphere from the air quality detector is received.

18. The heater of claim 15, the air quality detector configured to provide a signal indicative of a desired atmosphere when the temperature detector indicates a temperature corresponding to the desired atmosphere.

19. The heater of claim 15, the temperature of the detector flame is indicative of one or more of:

a desired atmosphere;

the non-desired atmosphere;

a first predictable temperature corresponding to the non-desired atmosphere;

a second predictable temperature corresponding to the desired atmosphere; and a predetermined criteria delineating the first predictable temperature from the second predictable temperature.

20. A heating device, comprising:

a catalytic heater fluidly coupled with an associated fuel source, the catalytic heater comprising a catalytic heating surface, comprising a catalyst and a substrate, the catalytic heater configured to perform one or more of:

generate heat in the presence of oxygen from the atmosphere and fuel; and release one or more combustion products into the atmosphere;

a valve, operably engaged between the catalytic heat heating surface and the fuel source, the valve configured to be disposed in a closed position in absence of a signal indicative of a desired atmosphere; and an oxygen depletion sensor (ODS) configured to detect the desired atmosphere and relay the signal indicative of a desired atmosphere to the valve, resulting in the valve being disposed in an open position, the ODS comprising, an ODS burner, fluidly coupled with the fuel source, the ODS burner configured to produce an ODS flame; and an ODS detector configured to detect a first property of the ODS flame, the first property of the ODS flame is indicative of a depleted oxygen content when the atmosphere comprises a carbon dioxide amount of more than 5000 PPM.

* * * * *